US009067128B2

(12) United States Patent
Qualey

(10) Patent No.: US 9,067,128 B2
(45) **Date of Patent: *Jun. 30, 2015**

(54) BALANCED SIX-SIDED DICE

(71) Applicant: Jeffery S. Qualey, Odenton, MD (US)

(72) Inventor: Jeffery S. Qualey, Odenton, MD (US)

( * ) Notice: Subject to any disclaimer, the term of this patent is extended or adjusted under 35 U.S.C. 154(b) by 77 days.

This patent is subject to a terminal disclaimer.

(21) Appl. No.: 13/948,224

(22) Filed: Jul. 23, 2013

(65) Prior Publication Data

US 2015/0028542 A1 Jan. 29, 2015

(51) Int. Cl.
*A63F 9/04* (2006.01)

(52) U.S. Cl.
CPC ..... *A63F 9/0413* (2013.01)

(58) Field of Classification Search
CPC ..... A63F 9/0413; A63F 2009/0426; A63F 2009/0473; A63F 2009/0471
USPC ..... 273/146; D21/372, 373
See application file for complete search history.

(56) References Cited

U.S. PATENT DOCUMENTS

| | | | | |
|---|---|---|---|---|
| 1,279,409 | A | 9/1918 | Murray | |
| 2,227,406 | A * | 12/1940 | Christy | 273/146 |
| 3,399,897 | A | 9/1968 | Mitchell | |
| D269,983 | S | 8/1983 | Lapadura | |
| 4,465,279 | A | 8/1984 | Larson | |
| 8,540,246 | B1 * | 9/2013 | Qualey | 273/146 |

OTHER PUBLICATIONS

Jeffery S. Qualey, U.S. Appl. No. 13/718,394, filed Dec. 18, 2012.
Jeffery S. Qualey, Design U.S. Appl. No. 29/460,952, filed Jul. 17, 2013.

* cited by examiner

*Primary Examiner* — Benjamin Layno
(74) *Attorney, Agent, or Firm* — McClure, Qualey & Rodack, LLP

(57) ABSTRACT

Balanced six-sided dice are provided. In this regard, a representative die includes a cubical body provided with a corresponding set of five indicia on each face, wherein four of the five indicia of each set form a square pattern with a fifth of the indicia being positioned at a center of the corresponding face.

7 Claims, 3 Drawing Sheets

BALANCED SIX-SIDED DICE

BACKGROUND

1. Technical Field

The present disclosure relates generally to dice and, more particularly, six-sided dice.

2. Description of the Prior Art

Multiple sided dice have been described in the prior art. By way of example, U.S. Pat. No. 1,279,409 (dated Sep. 17, 1918) to Murray, U.S. Pat. No. 3,399,897 (dated Sep. 3, 1968) to Mitchell, U.S. Pat. No. 4,465,279 (dated Aug. 14, 1984) to Larson, U.S. Pat. No. D269,983 (dated Aug. 2, 1993) to Lapadura disclosed dice of various configurations.

SUMMARY

Balanced six-sided dice are provided. In this regard, an example embodiment of a die comprises a cubical body provided with a corresponding set of five indicia on each face, wherein four of the five indicia of each set form a square pattern with a fifth of the indicia being positioned at a center of the corresponding face.

Other devices, systems, methods, features, and/or advantages of the present disclosure will be or may become apparent to one with skill in the art upon examination of the following drawings and detailed description. It is intended that all such additional devices, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Six-sided cubic dice are provided. In an example embodiment, on each face of the die, four indicia are placed at the vertices of a square shape, oriented 45 degrees from the edges of the cube, and one at the center. On all faces, the pattern is oriented the same. In this manner, a completely physically balanced die may be provided.

In some embodiments, all indicia are marked with pigment (e.g., paint), or otherwise, with either similar or contrasting color to maintain the physical balance. The contrasting colored "pips" represent the countable indicia from zero to five. The addition of the countable pips on one face, and its opposite face, equals five. Five is opposite zero, four is opposite one, and three is opposite two.

All countable pips on each face are vertically and horizontally symmetrical, meaning that the horizontal halves of each face are mirror images of each other and the vertical halves of each face are mirror images of each other. Furthermore, the opposite faces are complements, whereby together, the countable pips occupy all five indicia.

Figure 1:
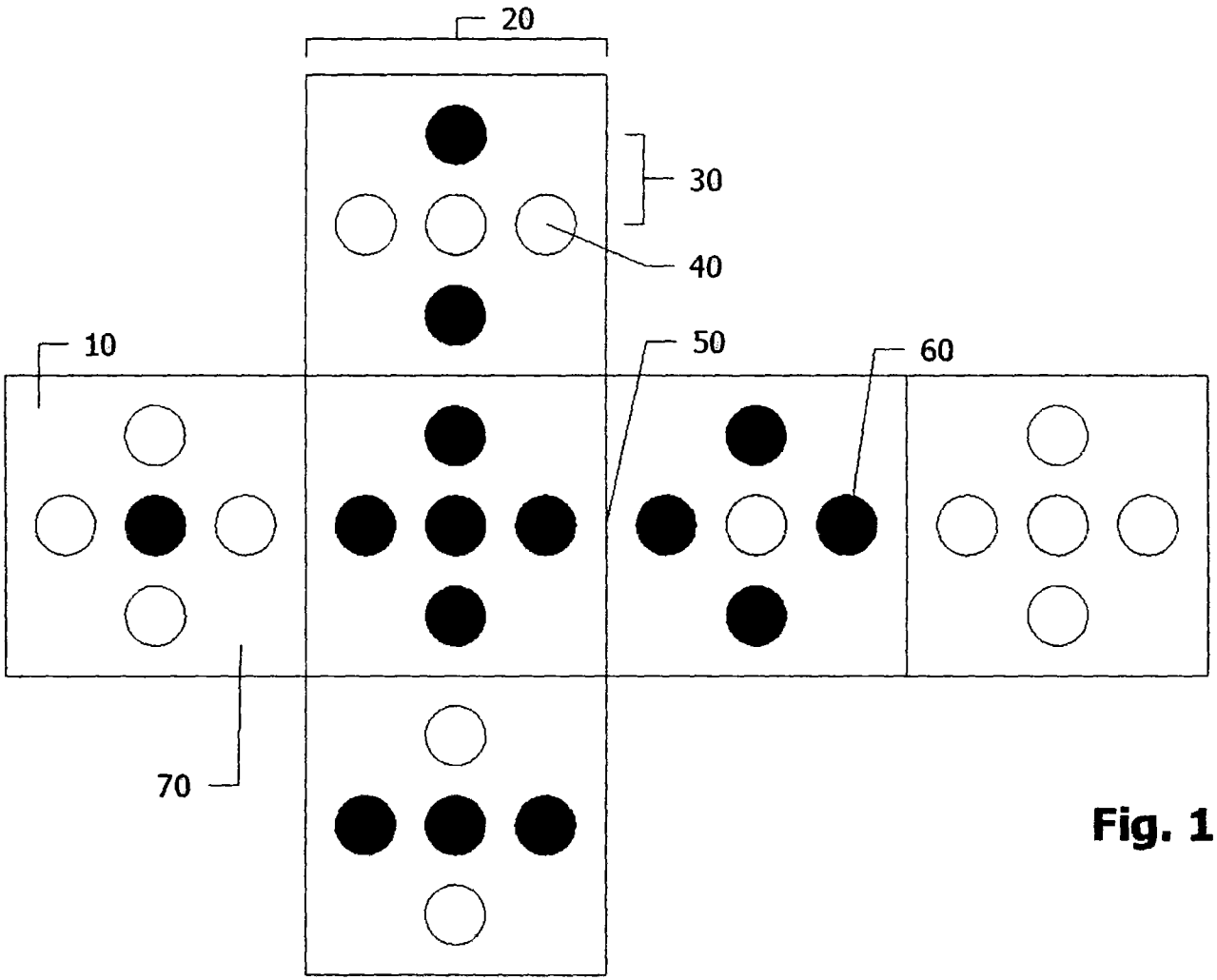
FIG. 1 is a net view of all faces of an embodiment of a die.

As shown in FIG. 1, a cubic die is provided. In some embodiments, the die may be prepared utilizing a CNC milling machine, although various other manners may be used in other embodiments. In this embodiment, the cube is solid, the composition (10) of which may be of hardwood, plastic, glass, rock, or other material, as may be limited by the machine, equipment and/or method of manufacture used.

The length of each edge of the cube (20) of this embodiment is the same, and may be of any size, but is expected to be most desirable in 16 mm (0.625") to 19 mm (0.75") for most board gaming uses. The radius of the square shape (30) represents approximately 30% of the length of each edge of the cube (20). The radius of each indicia (40) represents approximately 10% of the length of each edge of the cube (20).

The die has five indicia (40) on each face—placed at the vertices of a square shape and one at the center of each face. The pattern repeats on all faces, to ensure a physically balanced die. This is demonstrated by the pattern of two indicia at each edge of the cube (50), wherein a vertex of one face is closest to the edge, and a vertex of the adjacent face are closest to the edge.

All indicia are marked with either similar or contrasting color, and preferably in a similar manner, to maintain the physical balance. The contrasting colored "pips" (60) represent the countable indicia from zero to five. The addition of the pips (60) on one face, and its opposite face, equals five.

Figure 2:
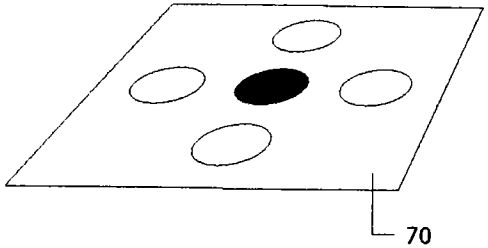
FIG. 2 is a plan view of a representative face of an embodiment of a die.
Figure 3:
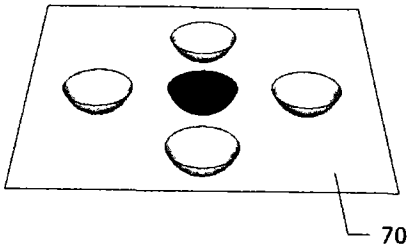
FIG. 3 is a plan view of another representative face of an embodiment of a die.
Figure 4:
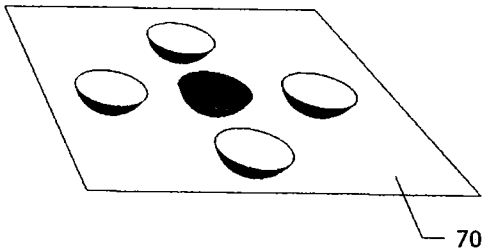
FIG. 4 is a plan view of another representative face of an embodiment of a die.

FIG. 2 is a face of the die (70) wherein the indicia are marked, with paint or otherwise, upon the face of the die. FIG. 3 is a face of the die (70) wherein the indicia are recessed and marked. FIG. 4 is a face of the die (70) wherein the indicia are recessed and filled in with another material of appropriate color, or with material of a neutral color and then marked.

Figure 5:
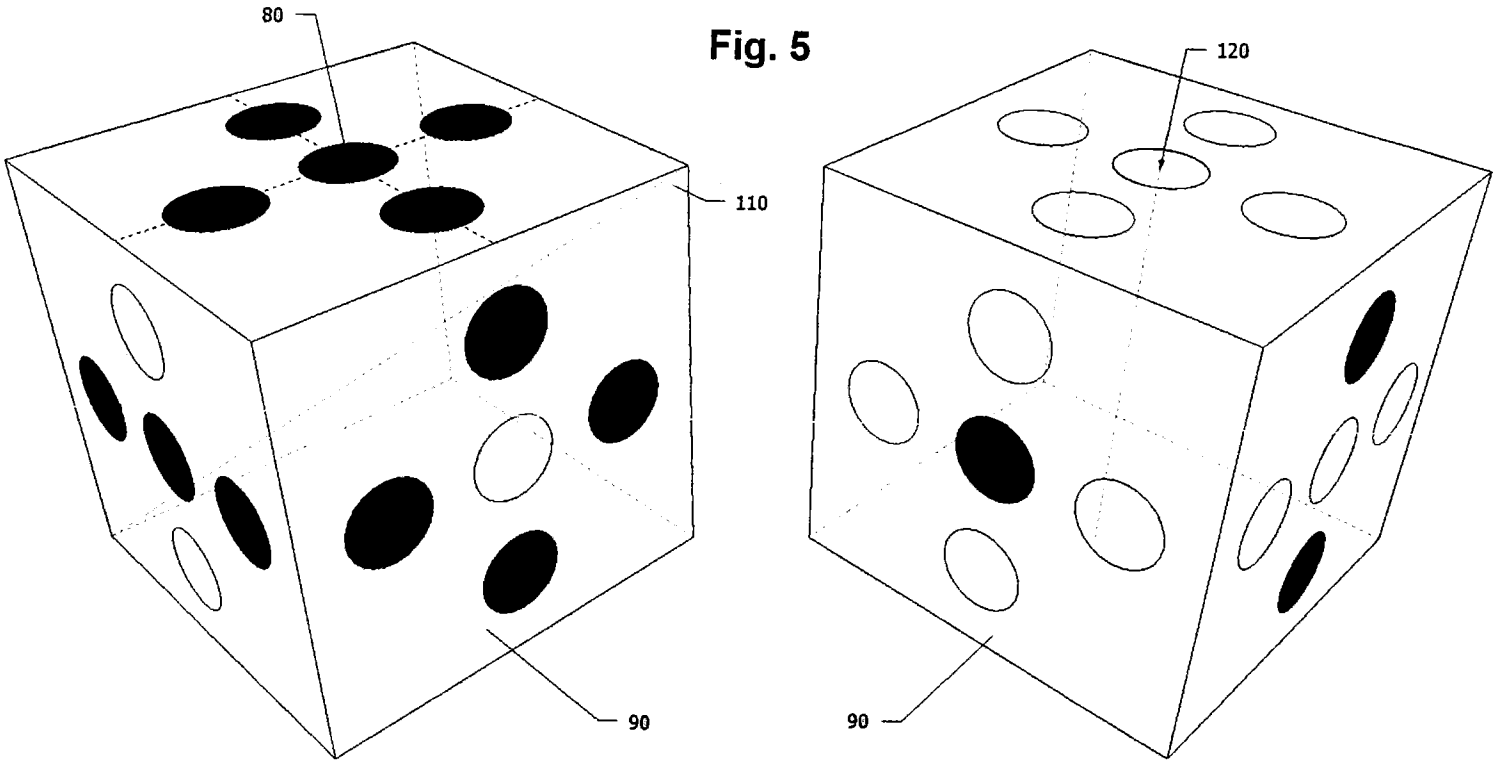
FIG. 5 is a three-dimensional view, from the vertex, of three faces of an embodiment of a die, and from the opposite vertex, a view of the remaining three faces (hidden geometry is shown).

FIG. 5 is a three-dimensional view, from the vertex, of three faces of an embodiment of a die, and from the opposite vertex, a view of the remaining three faces. In this embodiment, all pips (60) on each face are vertically and horizontally symmetrical (80), meaning that the horizontal halves of each face are mirror images of each other and the vertical halves of each face are mirror images of each other. Furthermore, the opposite faces are complements, whereby together, the pips (60) occupy all five indicia (90). Hidden geometry is shown to indicate one of the four space diagonals (110) and one of the three central axis (120).

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

I claim:

1. A die comprising:

a cubical body provided with a corresponding set of five indicia on each face, wherein:

four of the five indicia of each set form a square pattern with a fifth of the indicia being positioned at a center of the corresponding face, the indicia being distinguishable by colors to represent a first subset of the indicia that are to be counted and a second subset of the indicia that are not to be counted;

the square pattern of all faces oriented 45 degrees from parallel to the edge of each face such that the die exhibits symmetric weight distribution with respect to each of four space diagonals, each of the four space diagonals extending from a vertex of the cubical body through a center of the cubical body to an opposing vertex, such that weight distributed along one side of each of the space diagonals from the center of the cubical body is balanced by weight distributed along a corresponding opposing side of each of the space diagonals; and the die exhibits symmetric weight distribution with respect to each of three central axes, each of the three central axes extending through the center of the cubical body, such that weight distributed along each side of the cubic body is balanced by weight distributed along a corresponding opposing side of each of the three central axes.

2. The die of claim 1, wherein the indicia are formed by pigment.

3. The die of claim 1, wherein the indicia are formed by recesses.

4. The die of claim 3, wherein the recesses are colored by pigment.

5. The die of claim 3, wherein the recesses are filled by pigmented material.

6. The die of claim 1, wherein the first subset of the indicia that are to be counted exhibit vertical and horizontal symmetry.

7. The die of claim 1, wherein the first subset of the indicia that are to be counted on each face and its opposite face occupy all five indicia.

* * * * *